United States Patent [19]

Rookus

[11] 3,935,638

[45] Feb. 3, 1976

[54] SHARPENER FOR ELECTRIC SHAVERS

[76] Inventor: James E. Rookus, 505 Cherry, S.E., Grand Rapids, Mich. 49503

[22] Filed: June 12, 1974

[21] Appl. No.: 478,645

Related U.S. Application Data

[63] Continuation-in-part of Ser. No. 436,174, Jan. 24, 1974, abandoned.

[52] U.S. Cl. ..... 30/37; 51/241 S; 76/DIG. 9; 30/90

[51] Int. Cl.[2] ..... B26B 19/38

[58] Field of Search ..... 30/35, 37, 38, 90, 138, 30/43.92; 76/82, DIG. 9; 51/241 R, 241 S, 250

[56] References Cited

UNITED STATES PATENTS

| | | | |
|---|---|---|---|
| 1,742,054 | 12/1929 | Bennett | 30/138 X |
| 2,953,851 | 9/1960 | Wheeler | 51/241 R |
| 3,163,964 | 1/1965 | Wheeler | 30/37 UX |
| 3,319,334 | 5/1967 | Bond | 30/43.92 |
| 3,513,602 | 5/1970 | Fisher | 51/241 R |

FOREIGN PATENTS OR APPLICATIONS

| | | | |
|---|---|---|---|
| 640,782 | 9/1959 | Canada | 51/241 R |

*Primary Examiner*—Al Lawrence Smith
*Assistant Examiner*—Gary L. Smith
*Attorney, Agent, or Firm*—Price, Heneveld, Huizenga & Cooper

[57] ABSTRACT

The disclosed invention is an accessory for an electric shaver of the type having a removable cutting head equipped with one or more motor driven cutting blades. The accessory has a rigid body provided with a cutting blade receiving pocket or recess. The top face of the pocket is closed and has exposed to the cutting blade an abrasive material suitable for sharpening the blade. The body is of a size and shape that it may be interchanged with all or a portion of the cutting head on the razor and permits engagement between the razor's drive mechanism and a cutter blade while the same is engaged with the abrasive material so that operation of the razor's blade drive will drive the cutter blade while it engages the abrasive surface.

6 Claims, 24 Drawing Figures

SHARPENER FOR ELECTRIC SHAVERS

CROSS REFERENCE TO RELATED APPLICATION

The present application is a continuation-in-part application of Ser. No. 436,174 filed by Applicant on Jan. 24, 1974 and now abandoned.

BACKGROUND OF THE INVENTION

Electric shavers have a stationary screen or guard behind which a driven blade is rotated or reciprocated to shave the user by shearing the individual hairs which project through the openings in the screen. In the type of shaver to which this invention applies, the blade is perforated and is reciprocated while pressed firmly against the inner face of the screen. The sides of each of the perforations form a plurality of sharp cutting edges. After repeated use, these edges become dull. When this happens, it is conventional practice to replace the dull blade with a new one. This is both an expensive and a wasteful practice.

SUMMARY OF THE INVENTION

The invention provides a simple, compact, lightweight inexpensive means for sharpening the blades. In the type of electric shaver to which this invention applies, at least a portion of the head assembly of the razor is removable. The portion removed may include the guard, blades and the housing in which they are mounted, or it may only include the screen. In the case of shavers in which the head assembly is removed, the driving finger or fingers which drive the blades are exposed. In this case, the invention provides a replacement head having a pocket to receive a blade and hold the blade in engagement with one of the drive fingers. The head includes an abrasive surface designed to engage the cutting edges of the blade. It utilizes the spring normally employed to keep the blade pressed against the screen. By operating the motor of the razor, the blade is sharpened by the abrasive surface. The sharpening device is lightweight, compact and inexpensive, since it utilizes the shaver's existing power pack.

The invention will be more clearly understood upon reading the following description and the accompanying drawings.

DESCRIPTION OF THE PREFERRED EMBODIMENTS

Figure 1:
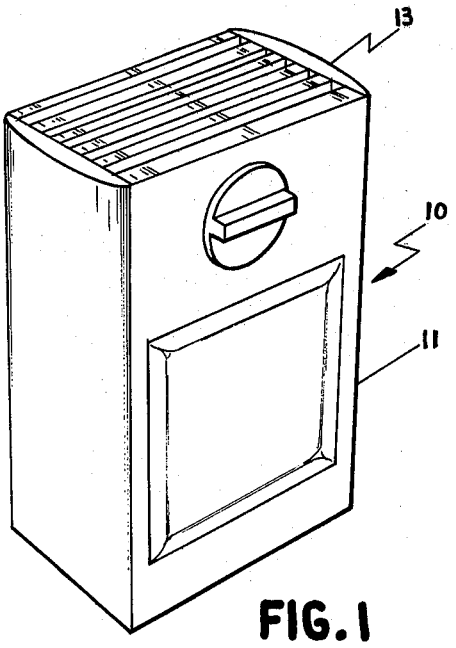
FIG. 1 is an oblique view of a razor with which this invention can be used.
Figure 2:
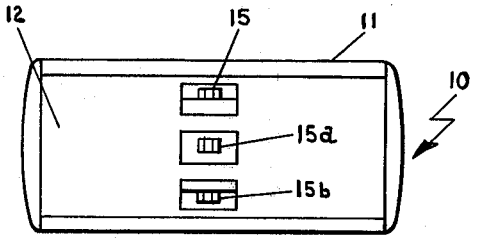
FIG. 2 is a plan view of the razor with the shaving head removed.
Figure 10:
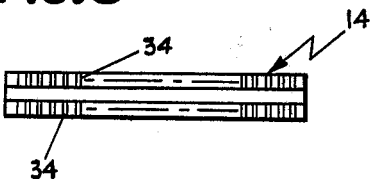
FIG. 10 is a plan view of a blade of the type which can be sharpened by this invention.

FIG. 1 illustrates a typical electric shaver 10 having a housing 11 encasing a motor. One end of the housing is open to provide a recessed seat 12 (FIG. 2), and a removable shaving head 13. Electric shavers of this type may have only one cutting blade 14 (FIG. 10) but more commonly have two or more of them. The illustrated shaver has three of them. Each blade is individually reciprocated by one of the fingers 15, 15*a* or 15*b*, driven by the motor. Removal of the shaving head 13 exposes these fingers.

Figure 3:
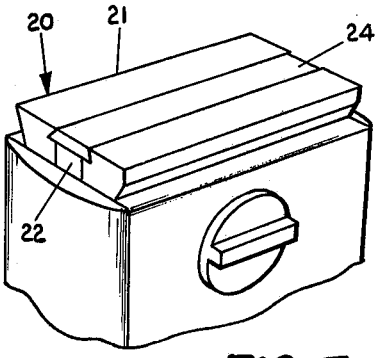
FIG. 3 is a fragmentary oblique view of the blade sharpener mounted on the razor body in place of the shaving head.
Figure 4:
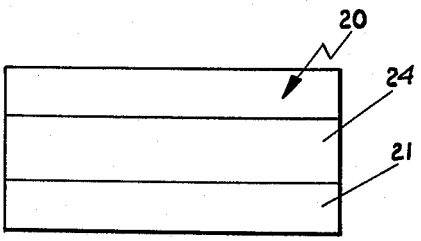
FIG. 4 is a plan view of the sharpener of this invention.
Figure 5:
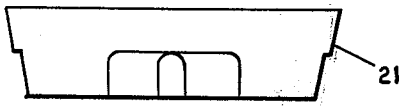
FIG. 5 is a side view of the sharpener.

The sharpener 20 has a rigid body 21 of a size and shape to be received in the shaving head recess 12. The body may be made of any suitable material. For lightness and appearance, a suitable material would be a cast polyamide such as Nylon. The body 21 has a central channel 22 (FIGS. 3 and 6) closed at the bottom except for a central elongated aperture 23 (FIG. 7). The top of the channel is closed by a strip 24 of abrasive material of fine grain suitable for sharpening a piece of steel. The strip 24 is rigidly secured to the body 20 by any suitable means such as by keying plus an adhesive.

Figure 6:
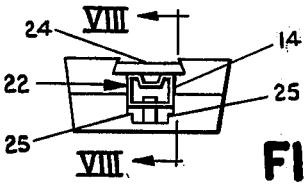
FIG. 6 is an end view of the sharpener with a blade seated in it.
Figure 7:
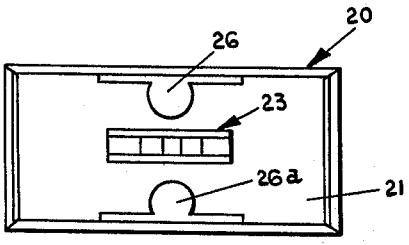
FIG. 7 is a bottom view of the sharpener.

Each side of the channel 22 has a ledge 25 which forms a seat for a blade 14 when it is first inserted in the channel (FIG. 6). The channel 22 is centrally located and is designed to cooperate with only the central drive finger 15a. Pocket-like openings 26 and 26*a* (FIG. 7) are provided in the bottom of the body to prevent interference with the other fingers 15 and 15*b*.

Figure 8:
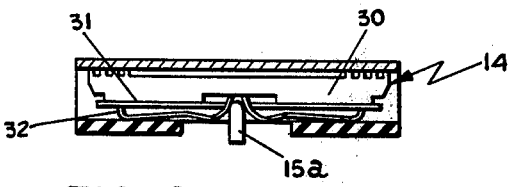
FIG. 8 is a sectional view taken along the plane VIII—VIII of FIG. 6.
Figure 9:
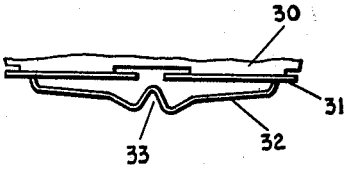
FIG. 9 is a view taken in the same plane as FIG. 8 but showing the blade supporting spring in released position.

The blade 14 consists of a cutter body 30, a bottom plate 31 and a spring 32 (FIGS. 8 and 9). The cutter body is rigidly secured to the bottom plate. The spring 32 is elongated and of the leaf-type. Its ends are secured to the bottom plate 31. Between its ends, the spring extends generally arched downwardly but at its center has an upwardly extending pocket 33 for receiving the finger 15*a*. The engagement of the finger 15*a* in the pocket 33 provides the means for driving the blades.

The upper surface of the cutter body has numerous narrow, transverse slits which divide this surface into a plurality of closely spaced knives 34. The edges of the knives do the actual cutting or shaving and the purpose of this invention is to sharpen these edges.

To sharpen a blade, it is inserted in the channel 22 from one end. In so doing, the spring 32 is compressed against the bottom plate 31, the spring being seated against the closed portions of the bottom of the channel (FIG. 8). The bias of the spring supports the top or knife surface of the blade against the abrasive strip 24. When the motor of the shaver body is activated, the blade is reciprocated in the channel in the same manner as it would be if it were mounted in the shaving head. This action sharpens the blade. The length of the sharpening cycle will vary somewhat, depending upon the condition of the blade. However, normally operating the motor for about 30 seconds is sufficient to fully restore the blade's sharpness. While the unit sharpens only one blade at a time, even a three blade shaver can be sharpened in about two minutes.

FIGS. 11–15 illustrate a shaver 50 of a type having a single blade 51 (FIG. 13) which is biased by the spring 52 to seat against the inside surface of a screen 53. The screen can be removed by detaching the bracket 54 which leaves the blade in place and operatively connected to the shaver's motor. This is conventional construction in certain makes of shavers.

Figure 14:
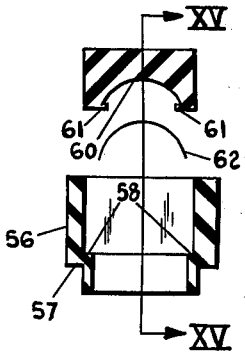
FIG. 14 is an exploded sectional view of the sharpener illustrated in FIGS. 12 and 13.

With the screen 53 removed, the sharpener unit 55 can be mounted over the blade. The sharpener unit has a generally rectangular case 56, the lower side portions of which are offset inwardly to create an exterior downwardly facing stop 57 and an inner, upwardly facing stop 58 (FIG. 14). The case 56 is open at both the top and the bottom. A cap 59 is seated in the open top. The lower face of the cap has a concave channel 60. At the very lower end of the channel 60, a narrow ledge 61 is formed on each side. The ledges 61 form a stop seating the ends of a thin sheet of abrasive material 62. By selecting a suitable abrasive material 62 such as Crocus Cloth, it can be placed under compression forcing it to assume the concave shape of the channel and seat firmly against the channel walls.

Figure 13:
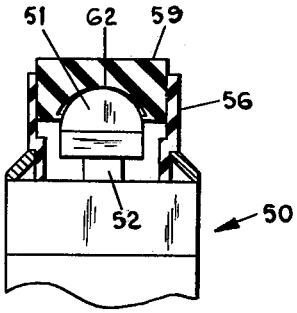
FIG. 13 is a sectional elevation view taken along the plane XIII—XIII of FIG. 12.
Figure 11:
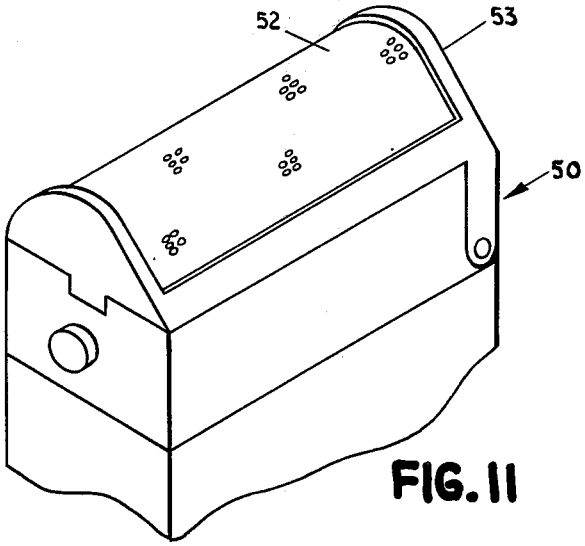
FIG. 11 is a fragmentary perspective view of the head end of a shaver of a somewhat different construction with the head in tact.
Figure 12:
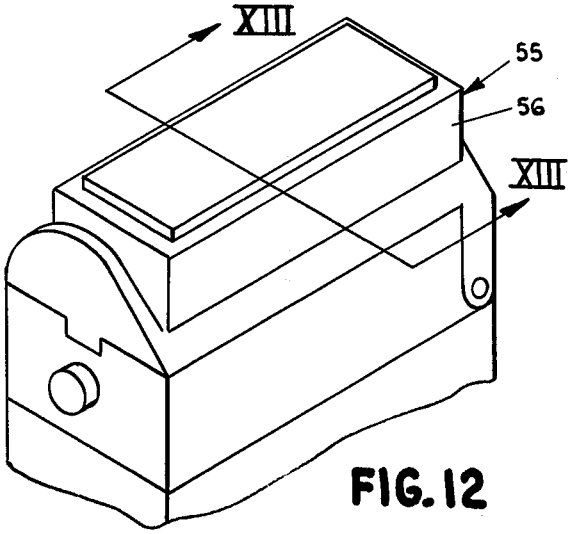
FIG. 12 is a view similar to FIG. 11 with the sharpener of this invention in place.
Figure 15:
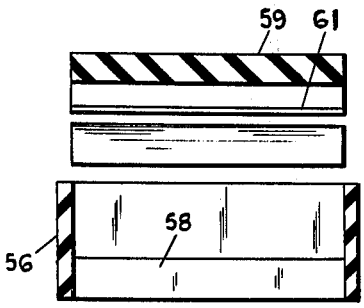
FIG. 15 is an exploded sectional view taken along the plane XV—XV of FIG. 14.
Figure 18:
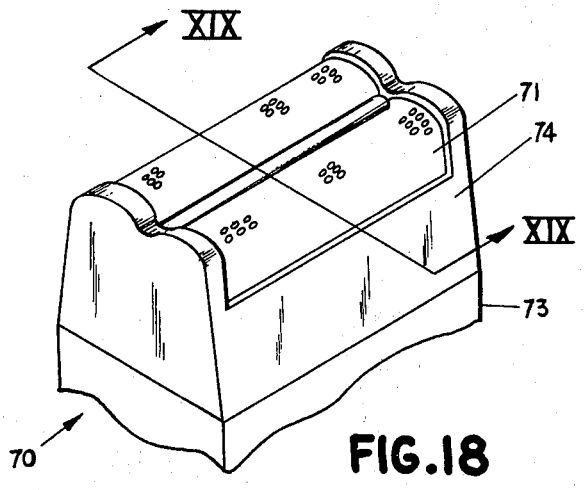
FIG. 18 is a fragmentary perspective view of the head end of another type of construction with the head in tact.
Figure 19:
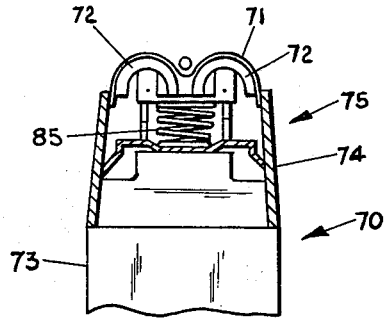
FIG. 19 is a fragmentary sectional view taken along the plane XIX—XIX of FIG. 18.
Figure 20:
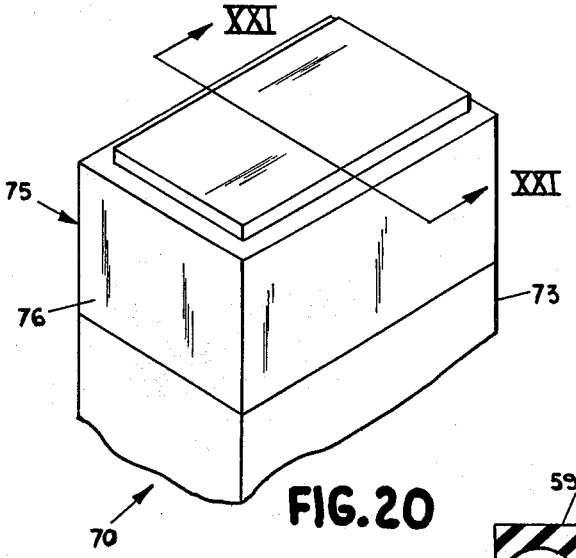
FIG. 20 is a view similar to FIG. 18 illustrating the shaver with the sharpener of the invention in place.

With the sharpener unit properly seated over the blade, as illustrated in FIG. 12, the blade 51 is received through the open bottom end of the case and seats in the concave channel 60 (FIG. 13). The operator then presses on the cap 59 to positively seat the abrasive against the blade and starts the shaver's motor. Sharpening then occurs in the same manner as that described in the case of the embodiment illustrated in FIGS. 1–10. The fact that the blade is springmounted prevents excessive pressure between the blade and the abrasive material. The inward movement of the cap is positively limited by the stops 58.

Figure 16:
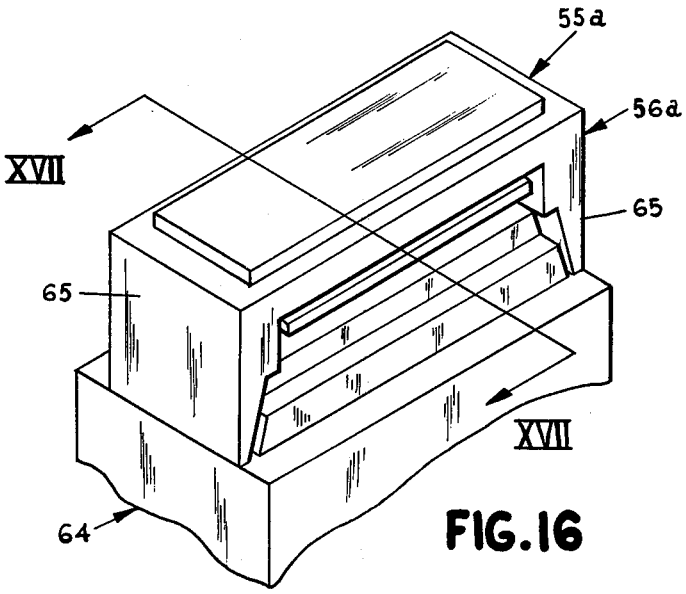
FIG. 16 is a fragmentary perspective view of the head end of a shaver of a still different construction with the sharpener of this invention in place.
Figure 17:
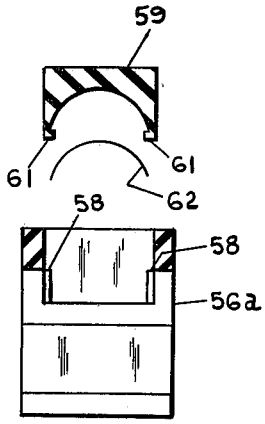
FIG. 17 is an exploded sectional view taken along the plane XVII—XVII of FIG. 16.

FIGS. 16 and 17 illustrate the invention applied to a shaver 64 of a slightly different construction. In the following description, identical features of the sharpener 55*a* have the same number as in FIGS. 11–15. The construction of the case 56*a* is different in that it has a pair of end legs 65 which seat down over the ends of the head and lock to the shaver body in the same manner as the screen and screen mounting frame which has been previously removed to expose the blade. The locking mechanism is not illustrated since it is conventional, being part of the construction of the shaver already on the market.

The shaver 55*a* has a cap 59 having an internal concave channel flanked at its lower ends by the narrow flanges 61 and seating the sheet of abrasive material 62. The case has an internal shoulder 58 forming a positive stop for the cap 59. The operation of the sharpener 55*a* is identical to that of the sharpener 55.

FIGS. 18–21 illustrate the application of this invention to a shaver having a pair of blades of the general type illustrated in FIGS. 11–17. In this shaver 70, the head has a removable screen 71 having a pair of convex surfaces to accommodate the two cutter blades 72. The screen is detachably secured to the shaver body 73 by a cover 74. To mount the sharpener of this invention on this shaver, the cover 74 and and screen 71 are removed exposing the blades 72.

The cover and screen are replaced by the sharpener 75 which has a case 76 designed to seat down over the head of the shaver and attach to the body 70 of the shaver in the same manner as the cover. Again, the exact means by which the case 76 attaches to the shaver body is neither illustrated nor described because it is not part of this invention and will vary from one make of shaver to another.

The case 76 is a hollow rectangular frame open at both the top and the bottom. Internally, it has a pair of stops 77 which facilitate its alignment on the shaver body. A bar 78 extends lengthwise at the top of the case dividing the top opening into two equal portions. The bar 78 is rectangular in cross section with its greatest dimension extending vertically. Seated in the case 76 through the top opening is a cap 80 having a pair of concave, parallel channels 81 in its lower face. These channels are so located and of a depth and shape to receive and seat the cutter blades 72. The lower ends of each of the channels has a narrow ledge 82. These ledges are identical to those illustrated and described in connection with FIG. 17. Each of the channels seats a piece of abrasive material 83 such as Crocus Cloth. The ledges hold the abrasive material 83 in an arched configuration to seat firmly against the walls of the channels as was described in connection with FIG. 17.

Between the channels 81, the cap has a longitudinal slot 84 of a width to fit closely about the bar 78. The depth of the slot 84 is such that when the cap is seated in the case, the cap may be pressed downwardly to positively engage the blades 72 with the abrasive material 83 in the channels. The close fit between the bar 78 and the walls of the slot 84 prevents the cap from tipping to one side or the other, thus, assuring equal contact pressure between each of the blades and the abrasive material.

Operation of the sharpener illustrated in FIGS. 18–21 is the same as that described for the sharpeness illustrated in FIGS. 11–17. The operator having substituted the sharpener for the screen and cover 74 presses the cap 80 downwardly until the blind end of the slot bottoms on the top of the bar 78. The motor of the shaver is then operated for a short period causing the blades 72 to be reciprocated against the abrasive material 83. This sharpens them and the sharpener can then be removed and the screen and cover restored. As in the case of the other shavers, the blades have a limited degree of float and when the cap is pressed into the case 76, the blade supporting spring 85 is compressed assuring positive bearing between the abrasive material and the blades.

Figure 22:
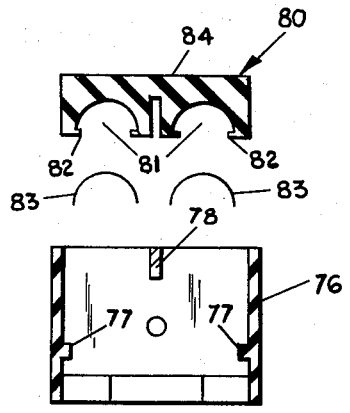
FIG. 22 is a sectional elevation view illustrating a modified construction for the means holding the abrasive.
Figure 22:
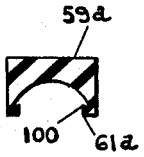
Figure 21:
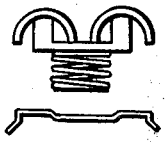
FIG. 21 is an exploded sectional view taken along the plane XXI—XXI of FIG. 20.

FIG. 22 illustrates a modified cap 59*a* in which the ledges 61*a* have upturned lips 100 creating a shallowing downwardly extending slot to seat the edges of the abrasive material. It will be recognized that this modification could be applied to any of the caps having the concave channel in their lower face.

Figure 23:
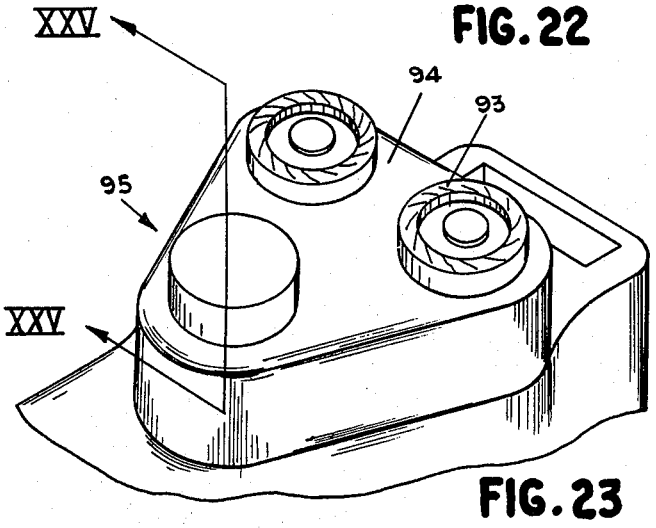
FIG. 23 is a fragmentary perspective view of the head of a shaver utilizing a rotary blade with a sharpener of this invention engaged with one of the blades.
Figure 24:
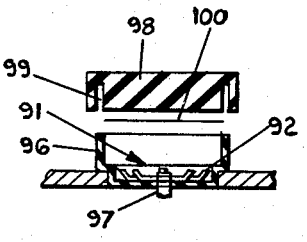
FIG. 24 is an exploded section elevation view of the sharpener shown in FIG. 23 taken along the plane XXIV—XXIV.

FIGS. 23 and 24 illustrate the invention applied to an electric shaver 90 of the rotary blade type. In this case, the blade 91 is somewhat cup-shaped and has its cutting edges 92 on the ends of the upstanding fingers. During normal use of the shaver, the blade rotates against and is spring pressed against a circular screen 93. By opening the cover 94 of the shaver head 95, the screen and cutter blade 91 can be removed. The mounting of the screen and the means of attachment of the cover are neither illustrated nor described since they are commerically available products and form no part of this invention.

The cutter blade 91 is removed from the screen and placed in the recessed cup 96 which has a central hole 97 to receive the shaft of the cutter blade. The lower portion of the cup is recessed to fit in the opening in the cover 94 normally occupied by the screen 93.

Cooperating with the cup is a cap 98 having an annular recess 99 in its bottom face. The recess receives the upstanding circular wall of the cup 96 thereby guiding and stabilizing the cap. The lower face of the cap with the recess 99 is provided with a suitable abrasive sharpening surface. In the particular embodiment illustrated, this is accomplished by bonding a disc 100 of Crocus Cloth to the bottom of the cap. To sharpen the blade 91, the operator presses on the cap 98 while the motor of the shaver is operating. The resilient mounting of the blade (a part of the conventional shaver) assures positive bearing between the blade and abrasive material. When one blade has been sharpened, the sharpening unit can be used for the next blade. The cap and cup can be made of any suitable material such as molded plastic.

It will be seen that the invention provides a very inexpensive sharpening means since it consists only of the body and the abrasive strip. It is lightweight because it is small and has no motor. It is very compact, being approximately the size of the shaving head and, therefore, can be readily packed with the shaver when traveling.

While a preferred embodiment of the invention has been described, it will be recognized that various modifications of the invention can be made without departing from the principles of the invention.

The embodiments of the invention in which an exclusive property or privilege is claimed are defined as follows:

1. Means for sharpening a cutter blade of an electric shaver having means resiliently mounting the cutter blade, said sharpening means comprising: a hollow case open at the bottom and shaped to seat over at least that portion of the shaver body having the cutter blade, cap means closing the top of said case; the inner face of said cap means being shaped to seat closely against the surface of a cutter blade; a thin sheet having an abrasive forming the inner surface of said cap; said cap having means for engaging the edges of said sheet for holding said sheet in compression and forcing it against the inner face of said cap; said cap when seated over said portion of said shaver body pressing said abrasive material firmly against the resiliently mounted cutter blade.

2. Means for sharpening a cutter blade as described in claim 1 wherein said sheet holding means are a pair of ledges projecting toward each other at the bottom edges of said shaped face of said cap.

3. Means for sharpening a cutter blade as described in claim 2 wherein said sheet is Crocus Cloth.

4. Means for sharpening a cutter blade of an electric shaver, having means resiliently mounting the cutter blade, said sharpening means comprising: a hollow case open at the bottom to seat over at least that portion of the shaver body having the cutter blade, cap means closing the top of said case; said cap having a pair of downwardly opening elongated channels, said channels being spaced apart, parallel and arcuate in cross section and said abrasive material covering the entire walls of said channel; a downwardly opening slot in said cap parallel to and between said channels; said case having a bar extending across and dividing the open top of said case, said bar fitting closely in said slot for guiding said cap as it is moved toward and away from the cutter blade.

5. Means for sharpening a cutter blade of an electric shaver having means resiliently mounting the cutter blade, said sharpening means comprising: a hollow case open at the bottom to seat over at least that portion of the shaver body having the cutter blade, cap means closing the top of said case; said cap being slidably mounted on said case for movement toward and away from the cutter blade; the inner face of said cap means being shaped to seat closely against the surface of the cutter blade; an abrasive material forming the inner surface of said cap, said cap when seated on said case pressing said abrasive material firmly against the cutter blade; said case being circular; said cap being circular and having guide means interfitting with said case to center said cap with respect to said case and to hold said inner face of said cap parallel with the top face of the cutter blade; said interfitting guide means being an upstanding annular wall on said case and a cooperating downwardly opening circular channel on said cap.

6. In combination, an electric shaver and blade sharpening means therefor, said electric shaver having at least one driven cutting blade, a removable screen; spring means resiliently urging said blade against said screen; said blade sharpening means having a hollow rigid body defining an internal cavity open at the bottom to seat over and be substituted for said screen with said blade received in said cavity; the top of said cavity being closed by a rigid blade engaging wall; said wall being a stationary part of said rigid body and having an inner rigid, non-compressible face for seating against said blade and displacing it against said spring means; the said inner face having an abrasive surface rigidly affixed thereto of a type adapted for sharpening said blade when said blade is moved over said surface.

* * * * *